United States Patent [19]

Tone et al.

[11] Patent Number: 4,953,798

[45] Date of Patent: Sep. 4, 1990

[54] WINDING UNIT

[75] Inventors: Shoichi Tone, Kyoto; Masaharu Kiriake, Joyo, both of Japan

[73] Assignee: Murata Kikai Kabushiki Kaisha, Kyoto, Japan

[21] Appl. No.: 321,525

[22] Filed: Mar. 9, 1989

[30] Foreign Application Priority Data

Mar. 17, 1988 [JP] Japan ..... 63-64198

[51] Int. Cl.[5] ..... B65H 54/20; B65H 67/02

[52] U.S. Cl. ..... 242/35.5 R; 242/35.5 A

[58] Field of Search ..... 242/35.5 R, 35.5 A; 57/274, 281

[56] References Cited

U.S. PATENT DOCUMENTS 3,382,659 5/1968 Schulz et al. ..... 57/281
4,597,540 7/1986 Kiriake ..... 242/35.5 A
5,630,435 12/1986 Igel ..... 57/281

*Primary Examiner*—Stanley N. Gilreath
*Attorney, Agent, or Firm*—Spensley, Horn, Jubas & Lubitz

[57] ABSTRACT

In the winding position of each winding unit there is provided a bobbin dislodgement preventing device adapted to come into abutment with part of a bobbin which is fed to the winding position as it is fitted upright on a tray with peg to thereby prevent the bobbin from coming off the peg.

6 Claims, 5 Drawing Sheets

WINDING UNIT

Field of the Invention

The present invention relates to a winding unit in an automatic winder.

Related Art Statement

In general, bobbins after spinning are removed simultaneously from the spindles of a spinning frame and once gathered, then fed to a winder in a required number at a time. In this bobbin feed step, as an apparatus for feeding bobbins positively using a simple means without flawing the yarn layer surface on each bobbin, there is, for example, such an apparatus as is disclosed in Japanese Patent Laid-Open No. 141361/82. According to this apparatus, each spinning bobbin is fitted upright on a peg formed on a disk-like tray, then the tray is conveyed by a conveyor, thereafter transferred onto a rotating disk of a winding unit to move the bobbin and the tray integrally to a winding position, where rewinding is performed followed by discharge.

In the above winding unit, the yarn on the bobbin which has been fed to the winding position is pulled out upwards in the axial direction of the bobbin while ballooning, then passes through a predetermined eyelet and is wound to a package. But, as the yarn layer becomes smaller in size and so the entire bobbin is reduced in weight, the upwardly pulling-out tension for the yarn acts to move the bobbin upwards, which may result in the bobbin finally coming off the peg of the tray. Further, with unwinding of the yarn, the bobbin may undergo rolling due to the gap between it and the peg of the tray, thus causing an obstacle to a high-speed travelling of the yarn.

Object and Summary of the Invention

It is an object of the present invention to prevent a bobbin from coming off a tray at a winding position of a winding unit.

According to the present invention, in the winding position of each winding unit there is provided a bobbin dislodgement preventing device adapted to come into abutment with part of a bobbin which is fed to the winding position as it is fitted upright on a tray with peg to thereby prevent the bobbin from coming off the peg.

Detailed Description of Preferred Embodiment

An embodiment of the present invention will be described below with reference t the drawings.

Figure 5:
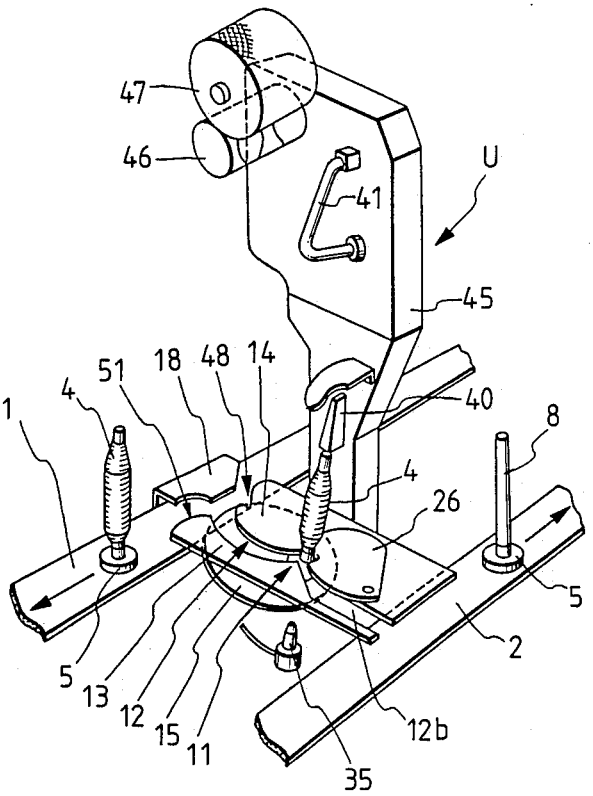
FIG. 5 is a schematic perspective view showing an example of construction of a winding unit.

FIG. 5 shows an example of a winding unit U which is suitable for the application of the present invention.

The unit U is mounted between a bobbin feed conveyor 1 and an empty bobbin return conveyor 2. Between the conveyors 1 and 2 is formed a tray passage 12 by a rotary disk 15 and guide plates 13, 14. A bobbin 4 on the feed conveyor 1 is conducted into the passage 12 integrally with the tray 5 and reaches a winding position 11. From the bobbin 4 thus arrived at the winding position yarn is pulled out axially of the bobbin, then passes through a balloon breaker 40 attached to a body frame 45 of the winding unit, a tension device (not shown), a slub catcher and a traverse drum 46, and is wound to a package 47. A guide plate 18 is fixed in the position of the feed conveyor 1 corresponding to each winding unit, whereby when there remains a bobbin space in the passage 12, bobbins on the conveyor are automatically conducted into the passage 12 through an inlet 48 as they are standing upright on the respective trays. When a predetermined number of bobbins have been stocked in the passage 12, the succeeding bobbin is prevented its admission by the rearmost tray in the passage 12, so without being taken into the passage 12, it passes a delivery side 51 and travels towards a winding unit located downstream.

Further, the bobbin after unwinding completely in the winding position 11 or a bobbin with residual yarn incapable of being subjected to yarn joining is discharged through a discharge passage **12*b* onto the return conveyor 2 by a discharge means, e.g. an eject lever 26**.

Numeral 35 denotes a yarn blowing-up nozzle disposed under the bobbin 4 in the winding position 11. It is a compressed air injection nozzle for blowing up the end of yarn which is suspended from the upper end of the bobbin through the central bore of the bobbin.

Figure 2:
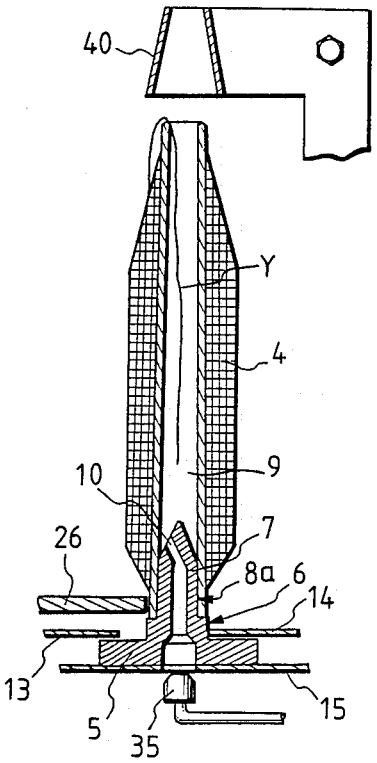
FIG. 2 is a sectional front view showing the state of a bobbin in a winding position.

The bobbin feed conveyor 1 conveys the bobbin 4 in the state shown in FIG. 2. The tray 5, which is hollow and disk-like, has a peg 7 implanted therein centrally through a stepped portion 6. The bobbin 4 is placed upright on the stepped portion 6 with the lower end of a take-up tube 8 thereof fitted on the peg 7. In a tip portion of the peg 7 is formed a through hole 10 which provides communication between the interior hollow portion of the tray and the central bore 9 of the take-up tube 8. The yarn end, designated Y, is found and suspended through the bore 9.

The feed conveyor 1 and the return conveyor 2 are disposed in positions different in height, and a bobbin feed/discharge device 3 is provided in an obliquely connecting form between both conveyors. Each bobbin 4 is conveyed to the winding position 11 by the feed conveyor 1 and wound there to a package, then is discharged as an empty bobbin 8 and conveyed by the return conveyor 2.

Figure 3:
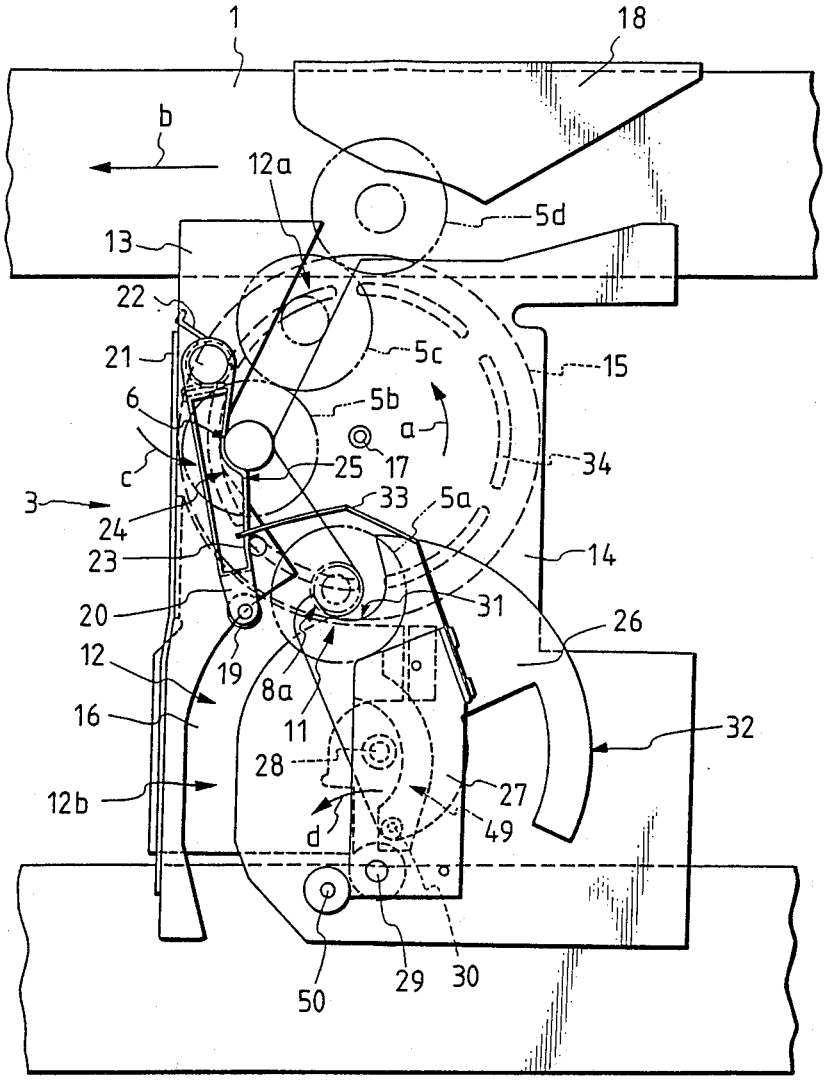
FIG. 3 is a plan view of FIG. 1.
Figure 4:
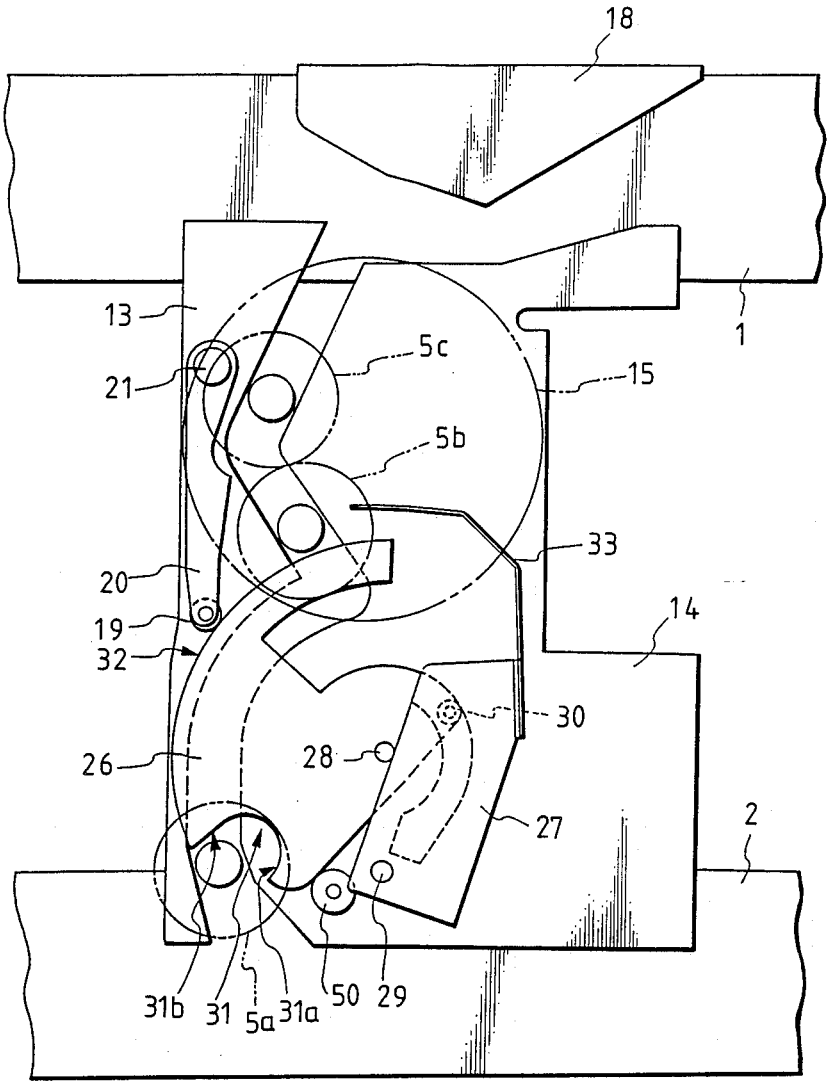
FIG. 4 is a plan view of the operation of the embodiment.

The details of the feed/discharge device 3 are shown in FIGS. 3 and 4. Between both conveyors 1 and 2 the first and second guide plates 13, 14 which form the curved passage 12 for the tray are fixed to the base of the winding unit. The disk 15, which is a free-rotating disk, serves as a lower surface of an incoming-side passage **12*a*, while the first guide plate 13 is bent as a bottom plate 16 which serves as a lower surface of an outgoing-side passage 12*b*. The feed conveyor 1, disk 15, bottom plate 16 and discharge conveyor 2 form planes which are contiguous to one another and approximately the same. Part of the disk 15 is in contact with the feed conveyor 1 and thereby given a rotating force in the direction of arrow, a, about a shaft 17. The feed conveyor 1 is further provided with a third guide plate, which is the guide plate 18. The guide plate 18 guides some of the trays 5 being conveyed in the direction of arrow, b, by the feed conveyor 1 into the incoming-side passage 12***a* and allows a surplus tray 5*d* to pass forward on the conveyor.

To the first guide plate 13 is pivoted a stopper 20 through a shaft 21. The stopper 20, having a free roller 19 at the distal end thereof, is urged rotatively in the direction of arrow, c, by a spring 22 and is in abutment with a pin 23 whereby its rotation is restricted. The stopper 20 has a convex portion 25 which, in an abutted condition of the stopper with the pin 23, makes the first curved portion of the passage 12, 12, i.e., the outlet of a stand-by position 24, narrower than the outside diameter of the stepped portion 6 of the tray 5, whereby the tray 5 which has been conducted into the incoming-side passage 12*a* by the feed conveyor 1 is stopped at the stand-by position 24 to always store two trays 5*b*, 5*c* in the incoming-side passage.

To the second guide plate 14 are pivoted an eject lever 26 and a balloon guide 27 through shafts 28 and 29, respectively. The eject lever 26 is provided with a roller shaft 30, which is in abutment with a cam groove 49 formed in the lower surface of the balloon guide lever 27.

Figure 1:
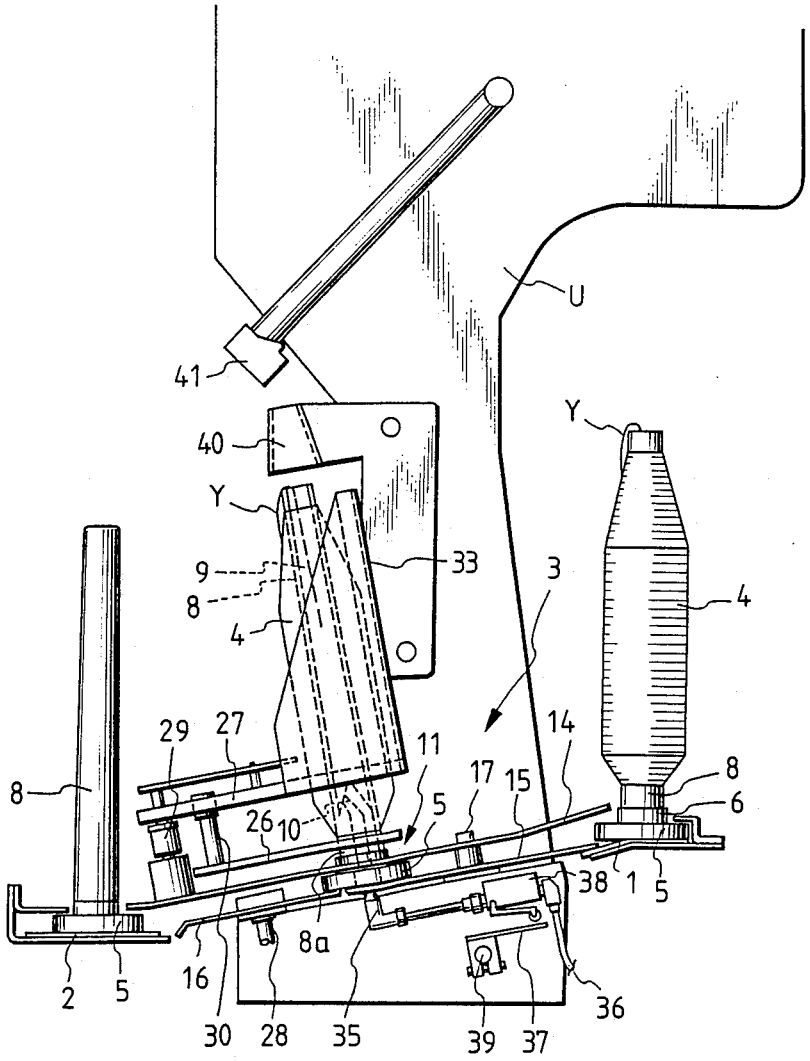
FIG. 1 is a side view showing an embodiment of the present invention.

In the winding position 11, which is a curved portion of the passage 12, the eject lever 26 has a concave portion 31 for pressing and holding a lower end portion 8*a* of the take-up tube of the bobbin on the tray as shown in FIG. 1, and thus the eject lever 26 also serves as a bobbin dislodgement preventing device. More specifically, in the winding state shown in FIG. 3, the take-up tube lower end portion 8*a* of the bobbin is sandwiched between the concave portion 31 of the eject lever 26 and the peg 7 of the tray, which tray is restricted in its upward movement by the guide plates 13 and 14, so that the bobbin 4 is held firmly in the winding position and thus prevented from coming off the peg 7 upwards. Further, since the bobbin is pressed against the peg, there is no fear of its wobbling laterally, and the bobbin axis is positioned in a predetermined constant position to prevent vertical and lateral movements of the bobbin caused by the unwinding tension of the yarn during winding of the yarn to the package.

In FIG. 3, the opposite side of the eject lever 26 is formed as a roller support edge 32 which is in the form of an arc around the shaft 28. The balloon guide 27, having a flat curved plate 33 at the distal end portion thereof, is rotatively urged in the direction of arrow, d, by a spring (not shown), which rotative motion is restricted by the roller 30 in abutment with the cam groove 49. Numeral 50 denotes a stopper for the eject lever 26.

The winding position 11 is on the disk 15 and a plurality of through holes 34 which are arcuate about the shaft 17 are formed in the portion of the disk 15 corresponding to the center of the peg 7 when the tray 5 is located in the winding position 11. Further, below the through holes 34 and in a position corresponding to the center of the peg 7 there is disposed the nozzle 35 for the injection of compressed air toward the through holes 34. As shown in FIG. 1, moreover, between the nozzle 35 and an air feed hose 36 there is provided a valve 38 which is on-off controlled by a lever 37. The air fed through the hose 36 is allowed to pass through the valve 38 by a turning motion of the lever 37 caused by rotation of a shaft 39, then passes through the nozzle 35 and enters the hollow portion of the tray 5 through a through hole 34 of the disk 15, further, passes through the through hole 10 of the peg 7 and enters the central bore of the take-up tube 8 to blow up the yarn end Y suspended in the bore 9.

The yarn end Y thus blown up passes through a yarn guide 40 fixed to the winding unit U, then is sucked and held by a suction pipe 41 which is in an upper stand-by position, and in this state it is joined with a package-side yarn end located outside the figure, followed by winding.

The operation of the bobbin feed/discharge device 3 will now be described with reference to FIGS. 3 and 4. First, in FIG. 3 showing a normal winding state, one tray 5*a* is located in the winding position 11, while two trays 5*b* and 5*c* are positioned in the incoming-side passage 12*a*.

At this time, the first tray 5*a* in the winding position 11 is supported and stopped at the take-up tube lower end 8*a* within the concave portion 31 of the eject lever 26, while the second tray 5*b* in the sand-by position 24 is prevented from being fed by the disk 15 with its stepped portion 6 in abutment with the convex portion 25 of the stopper 20.

The curved plate 33 of the balloon guide 27 is located between the first and second trays 5*a*, 5*b* to prevent the yarn balloon formed with unwinding of yarn from the bobbin 4 on the first tray 5*a* from affecting the bobbin 4 on the second tray 5*b*.

When the yarn winding from the bobbin on the first tray 5*a* to the package is over, this state is detected on the winding unit U side, which in turn energizes a solenoid (not shown) to turn the shaft 28 counterclockwise.

As a result, the eject lever 26 turns until it comes into abutment with the stopper 50 as in FIG. 4 while holding the first tray 5*a* in its concave portion 31 to discharge the first tray 5*a* onto the discharge conveyor 2 through the outgoing-side passage 12*b*.

With the above turning motion of the eject lever 26, the roller 30 thereon moves while pressing the cam groove 49 of the balloon guide 27 and causes the guide 27 to turn clockwise about the shaft 29. Further, the stepped portion 6 of the tray 5*a* and the roller support edge 32 of the eject lever 26 come into abutment with the free roller 19 of the stopper 20 to turn the stopper 20 clockwise about the shaft 21, thereby retracting the convex portion 25 of the stopper 20 leftwards.

Consequently, the second tray 5*b* is released from the convex portion 25, conveyed by the disk 15, comes into abutment with the roller support edge 32 of the eject lever 26 and is thereby stopped.

Then, when the solenoid is deenergized and the eject lever 26 returns to its original position, the balloon guide 27 and the stopper 20 also return to the respective original positions shown in FIG. 3, so that the second tray 5*b* which has been stopped by the roller support edge 32 is fed into the concave portion 31, i.e., the winding position 11. At the same time, the shaft 39 shown in FIG. 1 is rotated by a driving device (not shown) to open the valve 38, allowing compressed air to be injected from the nozzle 35 through a through hole 34 of the disk 15 and the through hole 10 of the peg 7, whereby the yarn end Y of the bobbin Y is blown up and held by the suction pipe 41. In this state, an ending operation and the subsequent winding operation are started.

At this time, the third tray 5*c* which has been located in the incoming-side passage 12*a* enters the stand-by position 24, following the second tray 5*b*, and is stopped by the convex portion 25 of the stopper 20. Further, one of the trays 5 being conveyed successively on the feed conveyor 1 is conducted into the incoming-side passage 12*a*.

In the bobbin feed/discharge device 3 described above, the winding position 11 for the tray 5 is on the disk 15 which is always negative-rotated by the feed conveyor 1, so that the transfer of the tray 5 from the stand-by position 24 to the winding position 11 is performed quickly and securely. Therefore, the air injection from the nozzle 35 and the aforesaid transfer of tray are effected in accurate timing and so the yarn end Y of the bobbin 4 is blown up surely by the air.

Besides, since the air is injected rectilinearly from the nozzle 35 to the through hole 10 of the peg 7 through a through hole 34 formed in the disk 15, the blowing-up of the yarn end Y is further ensured.

The first tray 5*a* and the second tray 5*b* are always kept out of contact with each other, and the is done simultaneously with the completion of discharge of the first tray 5*a*.

That is, at the time of discharge of the first tray 5*a*, the second tray 5*b* is not an obstacle thereto, and when the second tray 5*b* is fed, the first tray 5*a* does no hinder it.

In the above embodiment as shown in FIGS. 3 and 4, the bobbin positioning concave portion 31 of the eject lever 26 has a first abutment 31*a* for pressing part of the take-up tube of the bobbin and a second abutment 31*b* for pressing part of the take-up tube at the time of discharge of the bobbin. The abutments 31*a* and 31*b* are in positions corresponding to a height at which they abut the take-up tube portion positioned between the lower end face of the take-up tube 8 and the lower end of the yarn layer, as shown in FIG. 2.

It is possible to cause the second abutment 31*b* to push and discharge the tray portion 6 lower than the lower end of the take-up tube. It is also possible to form the concave portion 31 in the shape of a semi-arc of approximately the same diameter as that of the take-up tube. Further, the lower end portion of the take-up tube in the winding position may be gripped with two movable grippers.

The bobbin urging force of the concave portion 31 of the eject lever 26 is obtained by a spring (not shown), but it is sufficient for the spring to have a biasing force required to return the lever 26 to its original position. It suffices for the concave portion to be given an urging force which prevents the bobbin from coming off the peg under the yarn unwinding tension.

According to the present invention, as set forth hereinabove, each bobbin can be fed to the winding position as it is carried upright on a tray, and during the winding operation, it is fixed in that position by the bobbin pressing member, so can be prevented from coming off the tray, thus ensuring a stable winding operation.

What is Claimed Is:

1. In a winding unit operable with a bobbin and feeding means for feeding the bobbin to a winding position to be unwound, apparatus comprising:

a tray having a peg on which the bobbin is supported as the bobbin is fed to the winding position; and a bobbin dislodgement preventing means provided adjacent the winding position for contacting the exterior of the bobbin take-up tube to thereby prevent the bobbin from being dislodged from the peg as the bobbin is unwound.

2. The device as claimed in claim 1, further comprising:

a first guide plate; and a second guide plate, the first and second guide plates defining a tray passage;

wherein the bobbin dislodgement preventing means comprises an eject lever pivotally connected to one of the first and second guide plates, the eject lever having a concave portion adapted to press and hold the bobbin take-up tube on the tray at the winding position.

3. The device as claimed in claim 2, further comprising tray stopping means for stopping a tray at a stand-by position, the tray stopping means comprising:

means for moving a tray towards the winding position, a stopper having a convex portion and being pivotally connected to one of the first and second guide plates, and means for bring the convex portion of the stopper into abutment with a tray moving towards the winding position to thereby stop the tray at the stand-by position.

4. The device as claimed in claim 3, further comprising tray releasing means for releasing a tray stopped at the standby position, the tray releasing means comprising:

a free roller associated with the stopper, a substantially arcuate roller support edge provided on the eject lever, means for bringing the roller support edge into contact with the free roller to thereby move the stopper away from the tray at the stand-by position, whereby the convex portion of the stopper is retracted and the tray at the stand-by position is released and advanced to the winding position.

5. The device as claimed in claim 4, further comprising tray discharging means for discharging a tray from the winding position, the tray discharging means comprising:

a discharge conveyor, and means for turning the eject lever to thereby move the tray from the winding position onto the discharge conveyor.

6. The device as claimed in claim 5, further comprising:

a freely rotatable disk providing a lower surface for at least a portion of the tray passage, a feed conveyor for supplying bobbins to the winding unit, the feed conveyor and the rotating disk being in contact, whereby movement of the feed conveyor imparts a rotating force to the rotating disk, the feed conveyor and the discharge conveyor being disposed at different heights.

* * * * *